US005259993A

United States Patent [19]

Short

[11] Patent Number: 5,259,993

[45] Date of Patent: Nov. 9, 1993

[54] AQUEOUS CLEANER

[75] Inventor: Sidney M. Short, Fredonia, Wis.

[73] Assignee: Cook Composites and Polymers Co., Pt. Washington, Wis.

[21] Appl. No.: 823,682

[22] Filed: Jan. 21, 1992

[51] Int. Cl.[5] ..... C11D 1/18

[52] U.S. Cl. ..... 252/542; 252/174.16; 252/174.21; 252/174.22; 252/170; 252/544; 252/DIG. 14; 252/DIG. 17; 252/DIG. 18; 252/153; 252/524; 252/527; 134/38

[58] Field of Search ..... 252/174.16, 174.21, 252/174.22, 170, 544, DIG. 14, DIG. 17, DIG. 8, 153, 542, 524, 527; 134/38

[56] References Cited

U.S. PATENT DOCUMENTS

| | | | |
|---|---|---|---|
| 2,629,004 | 12/1971 | Cooper et al. | 134/31 |
| 3,954,648 | 5/1976 | Belcak et al. | 252/158 |
| 3,980,587 | 9/1976 | Sullivan | 252/546 |
| 4,054,534 | 10/1977 | Angelini | 252/158 |
| 4,276,186 | 6/1981 | Bakos et al. | 252/158 |
| 4,366,002 | 12/1982 | Carandang | 134/2 |
| 4,401,748 | 8/1983 | Ward, Jr. et al. | 430/258 |
| 4,530,781 | 7/1985 | Gipp | 252/546 |
| 4,619,706 | 10/1986 | Squires et al. | 134/2 |
| 4,689,168 | 8/1987 | Requejo | 252/139 |
| 4,752,411 | 6/1988 | Melin et al. | 252/174.16 |
| 4,828,569 | 5/1989 | Heath et al. | 8/137 |

*Primary Examiner*—Patrick P. Garvin
*Assistant Examiner*—E. D. Irzinski
*Attorney, Agent, or Firm*—Whyte Hirschboeck Dudek

[57] ABSTRACT

Dried resins, such as polyester sheet molding resins, are effectively removed from metallic surfaces by a cleaning composition prepared from a cleaning concentrate comprising an an organophosphoric ester surfactant; a nonionic surfactant, such as an acetylenic alcohol or diol, or a polyoxyethylene oxide ether of an alkyl phenol or alkanol; and a water-miscible solvent such as a 2-pyrrolidone, tetrahydrofurfuryl alcohol, or an ethoxylated THFA or furfuryl alcohol. The cleaning compositions can contain detergent builders, chelating agents, and other optional components.

17 Claims, No Drawings

AQUEOUS CLEANER

BACKGROUND OF THE INVENTION

This invention relates to aqueous cleaners. In one aspect, this invention relates to alkaline aqueous cleaners while in another aspect, the invention relates to the use of these cleaners to remove resin systems, particularly dried or partially dried systems, from the surfaces of resin molding process equipment.

In the manufacture of molded plastic articles, a molding resin is introduced into a mold and cured. The mold surfaces are constructed of materials to which the resins do not adhere, in either their cured or uncured state, and thus cleaning of the mold surfaces of resin is usually not a problem. However, other equipment associated with the molding process, particularly that equipment in which the uncured resin is mixed, held or transferred, is often constructed of materials to which the resins will adhere if the resin is allowed to dry while in contact with it. Accordingly, this equipment must be cleaned of the uncured resin after the bulk of the resin has been removed from it and before the remnants of the resin substantially dry.

Various cleaners are known to be useful for removing dried or partially dried resins from various surfaces or substrates. Many of these cleaners are organic based materials, such as methylene chloride, and while often very effective, their use does pose an obvious risk to worker health and environmental safety. As a consequence, aqueous based cleaners have been the subject of study for many years, and many such cleaners have been formulated. Typically, these cleaners contain a base, such as sodium hydroxide, that will break ester and ether linkages that may be present in the resin; a surfactant or wetting agent, such as a water-soluble, alkali compatible surfactant, e.g., phosphate esters or alkyl glucosides, to solubilize lower molecular weight components of the resin, such as a plasticizer or binder; and a detergent builder, such as an ammonium or alkali metal carbonate, phosphate or silicate, to dissolve soaps formed by the base and esters or ethers. These cleaners may contain other components as well, such as sequestering agents, corrosion inhibitors, dyes and perfumes.

While many, if not most, of the aqueous cleaners on the market today demonstrate at least some degree of utility for their intended purpose, most, if not all, could be improved in one manner or another. For example, some cleaners only work well at temperatures in excess of 140° F, temperatures at which cure is promoted in some resin systems, particularly catalyzed systems, and at which workers who come in unprotected contact with the cleaner could be scalded. Other cleaners lose critical components during use, e.g., through evaporation which results in either a limited period of use or a need to continually add the lost component. Yet other cleaners simply have a poor shelf life, i.e. they tend to separate into aqueous and nonaqueous fractions, or one or more components precipitate from solution, or the emulsion breaks. As a consequence, the search for new and useful aqueous cleaners continues.

SUMMARY OF THE INVENTION

According to this invention, resins, particularly those that are at least partially dried are effectively removed from the surfaces of various substrates through the action of an aqueous cleaning composition made from a cleaning concentrate comprising water and, in weight percent based on the weight of the concentrate, at least about:

A. 1% of an organophosphoric ester surfactant;

B. 0.1% of a nonionic surfactant selected from the group consisting of;

(1) an acetylenic alcohol or diol of the formula

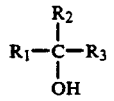

in which $R_1$ is an alkynyl radical of from 2 to 5 carbon atoms; $R_2$ is hydrogen or an alkyl radical or less than 4 carbon atoms; and $R_3$ is an alkyl or hydroxy alkyl radical of from 1 to 8 carbon atoms, the number of carbons in the molecule totaling 4 to 12;

(2) a polyoxyethylene oxide ether of an alkyl phenol or alkanol in which the alkyl radical has from 6 to 16 carbon atoms, and the number of ethylene oxide repeating units is from 4 to 10; and (3) a mixture thereof; and C. 1% of a water-miscible solvent selected from the group consisting of (1) a 2-pyrrolidone of the formula

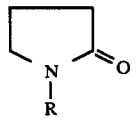

in which R is hydrogen, an alkyl radical of 1 to 3 carbon atoms, or a hydroxylalkyl radical of 1 to 3 carbon atoms;

(2) tetrahydrofurfuryl alcohol;

(3) an ethoxylated compound of the formula $RO(CH_2OH_2O)_nH$ in which R is

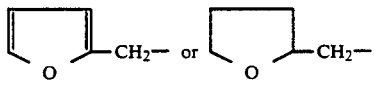

and n is about 0.5 to about 10; and (4) mixtures thereof.

These cleaning concentrates are diluted with water before use to form a cleaning composition, and the resulting compositions are particularly effective at removing highly filled polyester resins from the surfaces of metal, particularly steel, substrates. The cleaning compositions of this invention demonstrate good shelf life, stability under cleaning conditions, and are effective at temperatures under 140° F. The concentrates, and the compositions made from the concentrates by the addition of water, are homogeneous, single phase solutions at room temperature.

DESCRIPTION OF THE PREFERRED EMBODIMENTS

The organophosphoric ester surfactants that can be used in this invention include the oxyalkylenated phosphoric esters in which the alkyl chain of the esterifying group comprises from about 8 to about 12 carbon atoms and in which the oxyalkylenated or ether group comprises from 2 to about 18 oxyalkylene groups, preferably oxyethylene and/or oxypropylene, in the form of their alkali metal or alkanolamine salts. These esters include both the mono- and diesters, and mixtures of the two, and are more fully described in U.S. Pat. No. 4,752,411 to Melin et al. which is incorporated herein by reference. Maphos JP-70, manufactured by PPG-Mazer, is a preferred organophosphoric ester surfactant. The preferred minimum amount of this ester surfactant present in the cleaning concentrate is at least about 2 wt %, more preferably at least about 4 wt %. The maximum amount of this ester present is typically about 20 wt %, preferably about 12 wt %.

If the organophosphoric ester surfactant is not preneutralized, then preferably it is neutralized with an amine or an alkanolamine, or an alkali or alkaline earth metal hydroxide. Alkanolamines are preferred to amines, and the mono-, di- and tri-ethanolamines are preferred alkanolamines. The preferred alkaline earth metal hydroxides are calcium and magnesium hydroxide, and the preferred alkali metal hydroxides are sodium and potassium hydroxide. The alkali metal hydroxides are preferred to the alkaline earth metal hydroxides, and potassium hydroxide is preferred to sodium hydroxide. These hydroxides can be used alone or in combination with one another, but are typically used alone.

The preferred minimum amount of amine, alkanolamine, or hydroxide present in the cleaning concentrate is at least enough to fully neutralize the acidic organophosphoric ester, the exact amount a function of the amount and nature of the organophosphoric ester present in the concentrate. In some embodiments of this invention, an excess amount of hydroxide is used as a detergent builder. In these embodiments, the excess hydroxide adds significantly to the cleaning efficacy of the concentrate at relatively little added cost.

Of the acetylinic alcohols and diols that can be used as the nonionic surfactant of this invention, 3,5-dimethyl-1-hexyn-3-ol is preferred. This alcohol has the formula

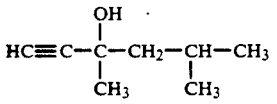

and is manufactured by Air Products and Chemicals, Inc. under the trademark Surfynol 61. Of the polyoxyethylene oxide ethers of an alkyl phenol that can be used as the nonionic surfactant of this invention, the octyl and nonylphenol ethoxylates are preferred, particularly those containing 4 to moles (repeating units) of the ethoxylate. These and the acetylenic alcohols and diols are more fully described in U.S. Pat. No. 4,689,168 to Requejo which is incorporated herein by reference. 3,5-Dimethyl-1-hexyn-3-ol is the preferred nonionic surfactant.

The preferred minimum amount of nonionic surfactant present in the cleaning concentrate i s at least about 0.1 wt more preferably at least about 0.5 wt %. The maximum amount of this surfactant present is usually about 10 wt %, and preferably about 5 wt %.

The R radical of the 2-pyrrolidone is preferably alkyl, more preferably methyl, and N-methyl-2-pyrrolidone is the preferred pyrrolidone for use in this invention. Ethoxylated tetrahydrofurfuryl alcohols are preferred to ethoxylated furfuryl alcohols, and tetrahydrofurfuryl alcohol (THFH) is preferred to ethoxylated THFA. Although the water-miscible solvent can comprise a mixture of the pyrrolidone, THFA, ethoxylated THFA and/or ethoxylated furfuryl alcohol, preferably it comprises only one. N-methyl-2-pyrrolidone is the preferred water-miscible solvent. The 2-pyrrolidone and the ethoxylated furfuryl and tetrahydrofurfuryl alcohols are more fully described in U.S. Pat. No. 4,401,748 to Ward, Jr. et al. and U.S. Pat. No. 4,366,002 to Carandang, respectively, both of which are incorporated herein by reference. Preferably, the water-miscible solvent comprises at least about 1 wt %, more preferably at least about 5 wt %, of the concentrate. The maximum amount of water-miscible solvent present in the concentrate usually does not exceed about 20 wt %, preferably not in excess of about 12 wt %.

In addition to the neutralizing amine, alkanolamine, or alkali or alkaline earth metal hydroxide, the cleaning concentrates of this invention can contain one or more other optional compatible additives that impart some desirable property to the concentrate. For example, detergent builders assist in emulsifying dissolved resin, and hydrated alkali or alkaline earth metal metasilicates are desirable ingredients in certain embodiments of this invention. The alkali metal metasilicates are preferred to the alkaline earth metal metasilicates, and sodium metasilicate pentahydrate is the preferred alkali metal metasilicate. If present, the preferred minimum amount of the metasilicate is at least about 5 wt %, more preferably at least about 8 wt %. The maximum amount is typically about 20.0 wt %, and is preferably not in excess of about 12 wt %. The hydrated metasilicates can be added per se, or formed in situ, e.g., sodium metasilicate pentahydrate can be added per se or as anhydrous sodium metasilicate which forms the pentahydrate upon addition of water.

Other additives that can be included in the concentrate include a sequestering or chelating agent, e.g., EDTA or tetrasodium ethylenediaminetetraacetate, to capture disassociated metal ions. Similarly, compatible perfumes, dyes and corrosion inhibitors can be incorporated into the concentrate to impart a desired scent, color or protection against corrosion.

One preferred embodiment of this invention comprises a cleaning concentrate that comprises water and between about:

A. 0.1 and about 0.9 wt % potassium hydroxide,

B. 1.0 and about 10.0 wt % Maphos JP-70 organophosphoric ester,

C. 5 and about 15 wt % sodium metasilicate pentahydrate,

D. 0.1 and about 2.0 wt % 3,5-dimethyl-1-hexyn-3-ol,

E. 5.0 and about 15.0 wt % N-methyl-2-pyrrolidone, and optionally

F. 0.1 and about 0.9 wt % tetrasodium ethylenediaminetetraacetate.

This embodiment is particularly effective in removing dried and partially dried, highly filled resins from metallic surfaces.

The individual components of the concentrate can be blended with one another in any manner, although preferably the hydroxide, if present, and organophosphoric ester surfactant are first dissolved in the water, and then the remaining components are added in any order to the solution until all are dissolved. The water and intermediate solutions can be heated to promote speed of dissolution, and are preferably constantly stirred until all the constituents of the formulation have dissolved.

The concentrates of this invention are preferably alkaline, and typically have a pH greater than about 10, preferably greater than about 12. When diluted to working strength, typically at least a 1:1 dilution and preferably a 5:1 dilution (with water as the diluent), the pH is usually greater than about 8, preferably greater than about 10. If the pH is to be adjusted to a preferable level, the adjustment is usually best made by the addition of an alkali metal hydroxide, e.g., KOH.

Once formulated, the concentrate can be stored under ambient conditions for extended periods of time. Depending upon the exact composition of the concentrate, some may show a minor amount of phase separation or precipitation of components but these components can be returned to the solution when ready for use by simple mechanical mixing, sometimes with the assistance of heat.

While the concentrate can be used without dilution to clean dried or partially dried resins from various surfaces or substrates, such full strength application is usually unnecessary to achieve the desired cleaning results. Typically, the concentrate is diluted at least five-fold with additional water, the exact extent of the dilution a factor of many variables such as the nature of the resin to be removed from the substrate, the nature of the substrate, the temperature at which the cleaner is applied to the resin, the extent of mechanical scrubbing, if any, associated with the use of the cleaning composition, and the like.

Any substrate that is not adversely affected by the cleaning composition of this invention can be cleaned by it of dried and partially dried resins. These substrates include both metals and nonmetals, though the latter are typically substrates made of construction grade plastics, i.e., plastics from which such items as hoses, tanks, fittings, etc. are made. Likewise, the metal substrates are typically made of metals used to fabricate such items as tanks, fittings, agitators, etc., with stainless steel representative of such metals.

Although the cleaning compositions of this invention are useful for removing wet, dried and partially dried resin from the surfaces of a wide variety of substrates, they are particularly useful in removing highly filled dried or partially dried polyester resins from the surfaces of metallic substrates. Dried resins are those that have been allowed to dry for more than about 24 hours, while partially dried resins have dried for less than about 24 hours, both under ambient conditions. Dried and partially dried resins are those that have hardened due to water or solvent evaporation, as opposed to cured through the activation of a curing catalyst or other curing agent, e.g., heat, radiation, etc. "Filled" means that the resins contain fillers, such as reinforcing fiber, calcium carbonate or talc, and "highly filled" means that more filler is present than resin, on a weight basis.

The cleaning compositions of this invention are used in the same manner as conventional cleaning compositions. After an appropriate dilution, the substrate to be cleaned is typically immersed in the composition which is typically maintained at a temperature between about 120° and 140° F. After a predetermined amount of time which can vary from a few minutes to hours, the substrate is removed and subjected to scrubbing. This process is repeated until the substrate has reached the desired level of cleanliness.

The following examples are illustrative embodiments of this invention. Unless indicated to the contrary, all parts and percentages are by weight.

DETAILED EMBODIMENTS

Example 1

Concentrate Formulation:

Potassium hydroxide and Maphos JP-70 (an organophosphate ester surfactant consisting of a mono- and diphosphate ester consisting of a 4–12 mole ethoxylate adduct of a 4–12 carbon aromatic alcohol, manufactured by PPG-Mazer, were added to room temperature water and mixed until dissolved. Sodium metasilicate pentahydrate, tetrasodium ethylenediaminetetraacetate, 3,5-dimethyl-1-hexyn-3-ol, and N-methyl-2-pyrrolidone were then added to the solution and mixed until all were dissolved. The resulting concentrate had the following composition:

| | |
|---|---|
| KOH | 0.5% |
| Maphos JP-70 | 5.0% |
| $Na_2SiO_3$-$(H_2O)_5$ | 10.5% |
| $Na_4$.EDTA | 0.4% |
| 3-5-Dimethyl-1-hexyn-3-ol | 1.0% |
| N-methyl-2-pyrrolidone | 10.0% |
| Water | 72.6% |

Twenty milliliters of this concentrate was then diluted with 100 ml of water and heated to 120° F for testing.

Test Procedure

Steel test bolts (3"×½") were coated on their threads with a polyester sheet molding compound (40 g of 144 Mix, 4 g of PG-91034 (a thickener), and 0.44 g of t-butyl perbenzoate (a curing catalyst), through the use of a wooden applicator such that the compound filled the bolt threads. The compound was then allowed to age on the bolts for 23 to 27 hours under ambient conditions.

The coated bolts were then placed in a beaker containing the 120 ml of cleaning composition prepared above. The composition was maintained at 120° F., and it was constantly stirred by a magnetic stirring bar. At five minute intervals, the test bolts were removed from the cleaning composition and scrubbed by hand with a medium to firm bristle toothbrush under a light stream of hot tap water for about 40 seconds. If the coated bolt was not clean after this scrubbing, it was returned to the cleaning composition for another 5 minute interval and then subjected to further scrubbing as described. This procedure was repeated until the bolt was cleaned of its polyester coating. For the cleaning composition of this example, twelve separate batches of bolts were cleaned. The average cleaning time was 24 minutes (approximately 5 washing-scrubbing cycles), with a range of from 10 minutes (2 cycles) to 40 minutes 8 cycles).

Example 2

The procedure of Example 1 was repeated with the same cleaning composition except that the temperature of the composition was 77° F. rather 120° F. The bolts were cleaned of the polyester sheet molding compound after 12 washing-scrubbing cycles.

Example 3

After five days of storage at 30° F., the concentrate of Example 1 had separated into its organic and aqueous constituents. After warming to room temperature, the concentrate was shaken by hand, and it returned to its original solution.

Examples 4–44 and Controls C-1 to C-6

The procedure of Example 1 was repeated except that the formulation of the cleaning concentrate was varied. The formulations and results are reported in the Table. The six ingredients (other than water) of the Example 1 formulation are the captions of columns 2–7, respectively. The wt % of each ingredient in the formulation is reported in the appropriate column opposite the example or control number for a given formulation. In those instances where one ingredient has been substituted for another, e.g., Example 4 in which TMN-6 was substituted for S-61, the entry reports both the substituted ingredient and its concentration in wt % (in Example 4, 4 wt %). In those instances where the concentration of the ingredient is changed, e.g., Example 4 in which 4 wt % TMN-6 is used in place of 1 wt % S-61, the difference is at the expense of the amount of water present in the formulation (Example 4 has 3% less water than Example 1).

In the column captioned "Cleaning Time", a single entry is the amount of time in minutes required to clean the bolt per the test procedure described in Example 1. In those examples in which the test procedure was repeated, e.g., Example 1, the first number of the first entry, i.e., "24" of "24/12", reports the average time to clean the bolt, and the second number of the first entry, i.e., "12"of "24/12", reports the number of times the test was repeated. The second entry, e.g., the "10–40" of Example 1, reports the range of times required to clean the bolts. For Example 1, in at least one of the 12 tests only 10 minutes or 2 washing-scrubbing cycles were required to clean the bolt while in at least one other test, at least 40 minutes or 8 washing-scrubbing cycles were required to clean the test bolt.

TABLE

| | Ingredients (wt %) | | | | | | Cleaning |
|---|---|---|---|---|---|---|---|
| Ex | KOH | Maphos JP-70 | SMS | $Na_4$-EDTA | S-61 | NMP | Time (min.) |
| C-1 | 0 | | 0 | 0 | 0 | 0 | 120 |
| 1 | 0.5% | 5% | 10.5% | 0.4% | 1% | 10% | 24/12 10–40 |
| 4 | " | " | " | " | TMN-6 (4%) | " | 20 |
| 5 | " | " | " | " | NP-6 (1%) | " | 20/5 5–35 |
| 6 | " | " | " | " | NP-6 (3%) | " | 18/4 5–35 |
| 7 | " | " | " | " | N-95 (1%) | " | 30 |
| 8 | " | " | " | " | CA-620 (1%) | " | 35 |
| 9 | " | " | " | " | CA-620 (5%) | " | 30 |
| 10 | " | " | " | " | TDA-6 (1%) | " | 40 |
| 11 | " | " | " | " | TDA-6 (3%) | " | 18/2 10–25 |
| 12 | " | " | " | " | 610-50R (1%) | " | 35 |
| 13 | " | " | " | " | 610-50R (3%) | " | 23/2 10–35 |
| C-2 | " | " | " | " | APG-225 (1%) | " | >120 |
| C-3 | " | " | " | " | APG-225 (3%) | " | 66 |
| C-4 | " | " | " | " | APG-300CS (1%) | " | 65 |
| C-5 | " | " | " | " | APG-300CS (3%) | " | >120 |
| C-6 | " | " | " | " | APG-300 (3%) | " | >120 |
| 14 | " | " | " | " | S-61 (1%) | THFA (10%) | 25 |
| 15 | " | " | " | 0% | " | NMP (10%) | 11/4 5–20 |
| 16 | 5% | " | " | 0.4% | " | " | 13/4 5–25 |
| 17 | 0.5% | " | $Na_2CO_3$ (10.5%) | " | " | " | 13/4 5–20 |
| 18 | 5% | " | 0% | " | " | " | 16/4 5–25 |
| 19 | 10% | " | 0% | " | " | " | 20/2 20–20 |
| 20 | 0.5% | " | TKPP (10.5%) | " | " | " | 21/7 5–40 |
| 21 | " | " | 0% | " | " | " | 30/5 15–40 |
| 22 | " | " | 0% | " | NP-6 (1%) | " | 18/2 15–20 |
| 23 | " | " | SMS (10.5%) | " | NP-4 (1%) | " | 35/6 15–50 |
| 24 | " | " | " | " | NP-4 (3%) | " | 28/3 20–40 |
| 25 | " | " | " | " | NP-8 (1%) | " | 25/2 15–35 |
| 26 | " | " | " | " | NP-8 (3%) | " | 27/3 20–40 |
| 27 | " | " | " | " | S-61 (1%) | EP6240 (10%) | 30/4 20–35 |
| 28 | " | Maphos 91 (5%) | " | " | " | NMP (10%) | 38/6 35–40 |
| 29 | " | Emphos PS 331 (5%) | " | " | " | " | 38/3 35–40 |
| 30 | " | Rhodafac L0529 (5%) | " | " | " | " | 45/3 45–45 |
| 31 | " | Rhodafac RS-610 (5%) | " | " | " | " | 50/3 50–50 |
| 32 | " | Rhodafac EX-660 (5%) | " | " | " | " | 40/3 40–40 |
| 33 | " | Rhodafac RM-710 (5%) | " | " | " | " | 38/6 35–40 |
| 34 | " | Maphos JP-70 (1%) | " | " | " | " | 39/5 35–40 |

TABLE-continued

| Ex | Ingredients (wt %) KOH | Maphos JP-70 | SMS | $Na_4$-EDTA | S-61 | NMP | Cleaning Time (min.) |
|---|---|---|---|---|---|---|---|
| 35 | " | 10% | " | " | " | " | 34/5 30–35 |
| 36 | " | 5% | 5% | " | " | " | 39/5 25–50 |
| 37 | " | 15% | 10.5% | " | " | " | 31/4 30–35 |
| 38 | " | 5% | " | " | " | (1%) | 37/3 25–45 |
| 39 | " | " | " | " | " | (5%) | 33/2 30–35 |
| 40 | " | " | " | " | " | (0%) | 35/2 35–35 |
| 41 | " | " | " | " | NP-8 (5%) | (10%) | 28/2 20–35 |
| 42 | " | " | " | " | NP-8 (10%) | " | 33/2 30–35 |
| 43 | " | " | " | " | (0%) | " | 37/3 35–40 |
| 44 | " | Maphos JP-60 (5%) | " | " | S-61 (1%) | " | 38/3 35–40 |

Glossary of Table Abbreviations

| | |
|---|---|
| SMS | Sodium metasilicate pentahydrate $Na_2SiO_3(H_2O)_5$ |
| S-61 | Surfynol 61 |
| Maphos 91 | An organophosphoric ester made by PPG-Mazer |
| Maphos JP-60 | An organophosphoric ester made by PPG-Mazer |
| Emphos PS331 | An organophosphoric ester made by Witco |
| Rhodafac L0521 | An organophosphoric ester made by Rhone-Poulenc |
| Rhodafac RS610 | An organophosphoric ester made by Rhone-Poulenc |
| Rhodafac EX660 | An organophosphoric ester made by Rhone-Poulenc |
| Rhodafac RM710 | An organophosphoric ester made by Rhone-Poulenc |
| TKPP | Tetrapotassium pyrophosphate |
| Nay EDTA | Tetrasodium ethylenediamine tetraacetic acid |
| TMN-6 | Trimethylnonanol ethoxylate |
| NP-4 | Nonylphenol 4 mole ethoxylate |
| NP-6 | Nonylphenol 6 mole ethoxylate |
| NP-8 | Nonylphenol 8 mole ethoxylate |
| N-95 | Nonylphenol 9.5 mole ethoxylate |
| CA-620 | Octylphenol ethoxylate made by GAF |
| 610-50R | Mixed linear alcohol ethoxylate made by Vista Chemical |
| APG-225 | An alkylglucoside made by Henkel |
| APG-300 | An alkylglucoside made by Henkel |
| APG-300CS | An alkylglucoside made by Henkel |
| THFA | Tetrahydrofurfuryl alcohol |
| EP-6240 | Polyethylene glycol monofurfuryl ether made by Quaker Oats |
| TDA | Tridecylalcohol ethyoxylate |

The results reported in the Table demonstrate the efficacy of the cleaning compositions of this invention. In Control C-1 the cleaning composition was simply plain tap water, and two hours or 24 washing-scrubbing cycles were required to clean the test bolt. In Example 1, as previously reported, twelve test bolts were cleaned in an average time of 4 minutes, some in as little as ten minutes, others in as much as 40 minutes (the variance in times attributable to one or more factors such as the force applied to the dried resin by the scrub brush, the extent to which the resin was dried, etc.).

In Examples 4–13, various nonionic surfactants based on polyoxyethylene oxide ethers of alkyl phenols or alkanols were substituted at various concentrations for the Surfynol-61, and preformed well. Some, such as TDA-6 at a 3 wt % concentration, preformed better. Controls C-2 to C-6 in which the hydrophile component of the nonionic surfactant was a sugar radical as opposed to an alkanol or alkyl phenol, preformed decidedly worse.

Example 14 reports that THFA preformed as well as NMP at similar concentrations, while Example 15 shows that a chelate, such as $Na_4$-EDTA is not necessary to the formulation. Example 16 shows that the amount of alkali metal hydroxide can be increased to obtain generally favorable results, and Example 17 shows that carbonate-based detergent builders can also be used in the formulations of this invention.

Examples 18 and 19 show the effective use of excess KOH as a detergent builder in the absence more traditional builders such as SMS and sodium carbonate. Example 20 shows the use of a pyrophosphate detergent builder, while Examples 21 and 22 show that the formulations of this invention are effective even in the absence of a builder, and with different nonionic surfactants.

Examples 23–26 demonstrate the effectiveness of yet other nonionic surfactants based on polyoxyethylene oxide ethers of nonyl phenols. Example 27 reports the efficacy of an ethoxylated furfuryl alcohol, and Examples 28–35 demonstrate the use of various organophosphoric esters at various concentrations. Examples 36–39 report the results from varying the concentration levels of the organophosphoric ester, detergent builder and water-miscible organic solvent.

Example 40 shows the effect of omitting the water-miscible solvent, and Example 43 the effect of omitting the nonionic surfactant. Examples 41–42 and 44 show the effect of varying the concentration of one particular nonionic surfactant, and the concentration and composition of an organophosphoric ester.

While the invention has been described in detail and with reference to specific embodiments, this detail and these embodiments are provided for the purpose of illustration only and are not to be construed as a limitation upon the scope of this invention as described in the following claims.

What is claimed is:

1. An aqueous cleaning concentrate useful for removing from a substrate a resin compound that is at least partially dried, the concentrates forming stable, homogeneous, single phase solutions at room temperature and comprising water and, in weight percent based upon the total weight of the concentrate:

A. between about 1% and about 20% of a neutralized organophosphoric ester surfactant;

B. between about 0.1% and about 10% of a nonionic surfactant selected from the group consisting of;

(1) an acetylenic alcohol or diol of the formula

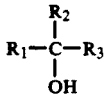

in which $R_1$ is an alkynyl radical of from 2 to 5 carbon atoms; $R_2$ is hydrogen or an alkyl radical of less than 4 carbon atoms; and $R_3$ is an alkyl or hydroxy alkyl radical of from 1 to 8 carbon atoms, the number of carbons in the molecule totaling 4 to 12;

(2) a polyoxyethylene oxide ether of an alkyl phenol or alkanol in which the alkyl radical has from 6 to 16 carbon atoms, and the number of ethylene oxide repeating units is from 4 to 10; and (3) a mixture thereof; and C. between about 1% and about 20% of a water-miscible solvent selected from the group consisting of (1) a 2-pyrrolidone of the formula

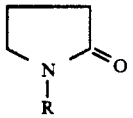

in which R is hydrogen, an alkyl radical of 1 to 3 carbon atoms, or a hydroxylalkyl radical of 1 to 3 carbon atoms;

(2) tetrahydrofurfuryl alcohol;

(3) an ethoxylated compound of the formula $RO(CH_2OH_2O)_nH$ in which R is

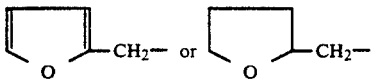

and n is about 0.5 to about 10; and (4) mixtures thereof.

2. The concentrate of claim 1 in which the organophosphoric ester surfactant is an oxyalkylenated phosphoric ester in which the alkyl chain of the esterifying group comprises from about 8–12 carbon atoms, and in which the oxyalkylenated group comprises from 2 to about 18 oxyalkylene groups in the form of their alkali metal or alkaline earth metal salts.

3. The concentrate of claim 2 in which at least one of the oxyalkenylene groups is selected from the group consistsing oxyethylene and oxypropylene.

4. The concentrate of claim 1 in which the nonionic surfactant is selected from the group consisting of 3,5-dialkyl-1-hexyn-3-ol, a polyoxyethylene oxide ether of an octylphenol, a nonyl phenol and tridecyl alcohol.

5. The concentrate of claim 2 in which the nonionic surfactant is selected from the group consisting of 3,5-dialkyl-1-hexyn-3-ol, a polyoxyethylene oxide ether of an octyl phenol, a nonyl phenol and tridecyl alcohol.

6. The concentrate of claim 1 in which the water-miscible solvent is selected from the group consisting of N-alkyl-2-pyrrolidone, tetrahydrofurfuryl alcohol, and an ethoxylated furfuryl alcohol.

7. The concentrate of claim 5 in which the water-miscible solvent is selected from the group consisting of N-alkyl-2-pyrrolidone, tetrahydrofurfuryl alcohol, and an ethoxylated furfuryl alcohol.

8. The concentrate of claim 1 in which the organophosphoric ester is present in at least about 4 wt %, the nonionic surfactant is present in at least about 0.5 wt %, and the water-miscible solvent is present in at least about 5 wt %.

9. The concentrate of claim 7 in which the organophosphoric ester is present in at least about 4 wt %, the nonionic surfactant is present in at least about 0.5 wt%, and the water-miscible solvent is present in at least about 5 wt %.

10. The concentrate of claim 9 further comprising at least about 0.1 wt % of an alkali metal or an alkaline earth metal hydroxide.

11. The concentrate of claim 10 further comprising at least about 5 wt % of a detergent builder selected from the group consisting of hydrated alkali metal metasilicates.

12. The concentrate of claim 11 comprising water and between about:

A. 0.1 and about 0.9 wt % potassium hydroxide;

B. 4 and about 20 wt % oroganophosphoric ester;

C. 5 and about 15 wt % sodium metasilicate pentahydrate;

D. 0.1 and about 2.0 wt % 3,5-dimethyl-1-hexyn3-ol;

E. 5 and about 15 wt % N-methyl-2-pyrrolidone, and optionally

F. 0.1 and about 0.9 wt % tetrasodium ethylenediamine tetraacetate.

13. A cleaning composition prepared by diluting the concentrate of claim 1 with at least an equal volume of water.

14. A cleaning composition prepared by diluting the concentrate of claim 8 with at least five volumes of water, each volume equal to the volume of the concentrate.

15. A cleaning composition prepared by diluting the concentrate of claim 9 with at least five volumes of water, each volume equal to the volume of the concentrate.

16. An aqueous cleaning composition useful for removing from a substrate a resin compound that is at least partially dried, the concentrates forming stable, homogeneous, single phase solutions at room temperature and comprising water and, in weight percent based upon the total weight of the concentrate, at least about:

A. between about 0.2% and about 4% of a neutralized organophosphoric ester surfactant;

B. between about 0.02% and about 2% of a nonionic surfactant selected from the group consisting of;

(1) an acetylenic alcohol or diol of the formula

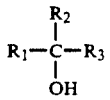

in which $R_1$ is an alkynyl radical of from 2 t 5 carbon atoms; $R_2$ is hydrogen or an alkyl radical of less than 4 carbon atoms; and $R_3$ is an alkyl or hydroxy alkyl radical of from 1 to 8 carbon atoms, the number of carbons in the molecule totaling 4 to 12;

(2) a polyoxyethylene oxide ether of an alkyl phenol or alkanol in which the alkyl radical has from 6 to 16 carbon atoms, and the number of ethylene oxide repeating units is from 4 to 10; and (3) a mixture thereof; and C. between about 0.2% and about 4% of a watermiscible solvent selected from the group consisting of (1) a 2-pyrrolidone of the formula

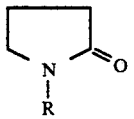

in which R is hydrogen, an alkyl radical of 1 to 3 carbon atoms, or a hydroxylalkyl radical of 1 to 3 carbon atoms;

(2) tetrahydrofurfuryl alcohol;

(3) an ethoxylated compound of the formula $RO(CH_2OH_2O)_nH$ in which R is

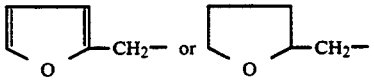

and n is about 0.5 to about 10; and (4) mixtures thereof.

17. The concentrate of claim 1 in which the organophosphoric ester surfactant is neutralized with at least one neutralizing agent selected from the group consisting from an amine, alkanolamine, alkali metal hydroxide and alkaline earth metal hydroxide.

* * * * *